US010518193B2

(12) United States Patent
You

(10) Patent No.: US 10,518,193 B2
(45) Date of Patent: Dec. 31, 2019

(54) TOY CONSTRUCTION SET

(71) Applicant: Ningsi You, Baulkham Hills (AU)

(72) Inventor: Ningsi You, Baulkham Hills (AU)

( * ) Notice: Subject to any disclaimer, the term of this patent is extended or adjusted under 35 U.S.C. 154(b) by 0 days.

(21) Appl. No.: 15/743,050

(22) PCT Filed: Jul. 11, 2016

(86) PCT No.: PCT/AU2016/050604
§ 371 (c)(1),
(2) Date: Jan. 9, 2018

(87) PCT Pub. No.: WO2017/008110
PCT Pub. Date: Jan. 19, 2017

(65) Prior Publication Data

US 2018/0229147 A1 Aug. 16, 2018

(30) Foreign Application Priority Data

Jul. 10, 2015 (AU) ..... 2015902738

(51) Int. Cl.
*A63H 33/10* (2006.01)
*A63H 33/12* (2006.01)
*A63H 33/06* (2006.01)

(52) U.S. Cl.
CPC ..... *A63H 33/107* (2013.01); *A63H 33/06* (2013.01); *A63H 33/108* (2013.01); *A63H 33/12* (2013.01)

(58) Field of Classification Search
CPC ..... A63H 33/06; A63H 33/062; A63H 33/08; A63H 33/086; A63H 33/10; A63H 33/101; A63H 33/102; A63H 33/108
(Continued)

(56) References Cited

U.S. PATENT DOCUMENTS 604,708 A * 5/1898 Burton ..... A63H 33/105
446/122
1,472,536 A * 10/1923 Thomson ..... A63H 33/108
434/403

(Continued)

FOREIGN PATENT DOCUMENTS

DE 1603603 3/1972
FR 1180316 6/1959

(Continued)

OTHER PUBLICATIONS

International Search Report dated Sep. 2, 2016, issued in International Application No. PCT/AU2016/050604 (3 pages).

(Continued)

*Primary Examiner* — Alexander R Niconovich
(74) *Attorney, Agent, or Firm* — Nixon & Vanderhye P.C.

(57) ABSTRACT

A toy construction set comprising operatively interconnectable blocks and connectors. Each of the blocks has one or more apertures formed in relief Each of the connectors has a base in the form of a plate or rod and a plurality of pins attached to the base in a spaced apart arrangement for interconnecting blocks. The pins are integral with the base plate. The interconnection between a block and a connector is achieved by the pins being positively engaging and releasably retained within one or more of the apertures of the blocks. The pins are oppositely disposed of a base plate so that a block can be connected to a connector on one side of the base plate, and another block can be connected to the same connector on the other side of the plate.

17 Claims, 8 Drawing Sheets

(58) Field of Classification Search
USPC ..... 446/116, 120, 122, 124, 126, 128
See application file for complete search history.

(56) References Cited

U.S. PATENT DOCUMENTS 1,718,230 A * 6/1929 Graves ..... A63H 33/06 446/116
2,093,341 A * 9/1937 Reiche ..... A63H 33/102 446/104
2,493,435 A * 1/1950 Arehambault ..... A63H 33/088 446/122
2,885,822 A * 5/1959 Onanian ..... A63H 33/101 446/121
2,940,760 A * 6/1960 Brinkman, Jr. ..... A63F 9/12 273/241
2,943,415 A * 7/1960 Viken ..... A63H 33/088 446/116
3,195,266 A * 7/1965 Onanian ..... A63H 33/101 446/86
3,242,610 A * 3/1966 Christiansen ..... A63H 33/086 446/128
3,264,021 A * 8/1966 Artman ..... A63H 33/101 403/3
3,603,026 A * 9/1971 Kishigami ..... A63H 33/108 446/122
3,689,075 A * 9/1972 Adelsohn ..... A63F 9/12 273/157 R
3,706,473 A * 12/1972 Mullen ..... A47B 87/007 297/452.16
4,078,328 A * 3/1978 Rayment ..... A63H 33/108 446/102
4,326,354 A * 4/1982 Hagberg ..... A63H 33/108 446/126
4,454,699 A * 6/1984 Strobl ..... F16B 21/082 403/298
4,565,042 A * 1/1986 von Poschinger-Camphausen ..... A47B 47/042 446/122
4,602,908 A * 7/1986 Kroeber ..... A63H 33/088 446/124
4,608,799 A * 9/1986 Hasegawa ..... A63H 33/10 446/112
4,992,069 A * 2/1991 Bolli ..... A63H 33/04 182/178.5
5,238,438 A * 8/1993 Glickman ..... A63H 33/101 446/120
5,281,185 A * 1/1994 Lee ..... A63H 33/10 446/109
5,306,198 A * 4/1994 Forman ..... A63F 9/0098 446/116
5,310,376 A * 5/1994 Mayuzumi ..... A63H 33/04 446/107
5,481,812 A * 1/1996 Pedano ..... E04G 21/1841 33/518
5,645,464 A * 7/1997 Chen ..... A63H 33/10 403/300
5,681,201 A * 10/1997 Choi ..... A63H 33/082 446/105
5,816,882 A * 10/1998 Guegan ..... A63H 33/12 446/123
5,824,906 A 10/1998 Lohmann
5,833,512 A 11/1998 Nicola
5,938,498 A * 8/1999 Glynn ..... A63H 33/10 446/124
5,964,635 A * 10/1999 Krog ..... A63H 33/101 446/116
6,641,453 B1 * 11/2003 Morales ..... A63H 33/04 273/157 R
7,191,571 B2 * 3/2007 Schools ..... E04B 2/18 52/439
7,347,028 B1 3/2008 Bin-Nun et al.
7,967,656 B2 * 6/2011 Hu ..... A63H 33/10 446/123
8,834,225 B2 * 9/2014 Ferron ..... A63H 33/107 446/117
9,022,829 B2 5/2015 Rosen et al.
9,044,690 B2 6/2015 Uttley et al.
9,220,993 B1 * 12/2015 Alsaleh ..... A63H 33/08
9,303,400 B2 * 4/2016 Maeers ..... E04B 2/16
9,345,982 B2 * 5/2016 Farco ..... A63H 33/10
9,555,339 B2 * 1/2017 Lu ..... A63H 33/10
10,058,792 B2 * 8/2018 Slepov ..... A63H 33/12
2007/0130874 A1 * 6/2007 Teng-Fu ..... A47B 96/1408 52/633
2008/0220689 A1 * 9/2008 Mimlitch ..... A63H 33/108 446/91
2012/0213961 A1 * 8/2012 Graham ..... A47B 47/0075 428/43
2013/0012098 A1 * 1/2013 Meys ..... A63H 33/062 446/85
2014/0024283 A1 * 1/2014 Stolten ..... A63H 33/086 446/119
2014/0241791 A1 * 8/2014 Kim ..... F16B 2/26 403/274
2014/0273712 A1 * 9/2014 Uttley ..... A63H 33/102 446/121

FOREIGN PATENT DOCUMENTS

| | | |
|---|---|---|
| GB | 2411605 | 9/2006 |
| JP | 3198058 U | 6/2015 |
| KR | 101385989 B1 | 4/2014 |
| WO | 2008082271 A1 | 7/2008 |

OTHER PUBLICATIONS

Written Opinion of the International Searching Authority dated Sep. 2, 2016, issued in International Application No. PCT/AU2016/050604 (4 pages).
Supplementary European Search Report for European Counterpart Application No. EP 16 82 3551. Jan. 31, 2019. 6 pages.

* cited by examiner 15a
19
21
21

15b
19
21
21

15c
21
19
19
23

15d
25
21

15e
21
27
21a 15f
21
29

15g
31
21

TOY CONSTRUCTION SET

This application claims benefit of PCT/AU2016/050604 filed Jul. 11, 2016, which claims benefit of Australian Patent Application Serial No. 2015903358, filed Jul. 10, 2015, both of which are incorporated by reference in their entirety.

FIELD OF THE INVENTION

This invention relates to toy construction sets including a block and a connector.

Throughout the specification, unless the context requires otherwise, the word "comprise" or variations such as "comprises" or "comprising", will be understood to imply the inclusion of a stated integer or group of integers but not the exclusion of any other integer or group of integers.

BACKGROUND ART

The following discussion of the background art is intended to facilitate an understanding of the present invention only. It should be appreciated that the discussion is not an acknowledgement or admission that any of the material referred to was part of the common general knowledge as at the priority date of the application.

Toy construction sets are among the most popular and inspiring toys for children. Traditional construction toys include wooden blocks that generations of children have played with during their formative years. More modern versions of toy construction sets most notably include those produced by Lego AS of Denmark, and its corporate predecessors. The basic familiar form of Lego™ toy sets is generally described in U.S. Pat. No. 3,005,282, and many variations have developed over the years based upon the same approach.

Wooden blocks are stackable, and many differently shaped blocks may be included in any given set. The child can play by stacking the blocks one on another. As there is no connection between any parts, all blocks must be supported by other blocks directly beneath. So the stacked blocks are very easy to collapse, however the complexity of the structures that can be achieved using this type of construction set is inherently limited by the lack of interconnectability between the components.

Lego™ blocks provide an advance over traditional wooden blocks, as these blocks feature upper and lower surfaces having mating male and female connectors. This connectivity permits upwards or downwards construction, and more complex, bigger and more robust structures can be configured as a consequence. That is one important reason why Lego™ has become the most popular construction toy set, globally. However, Lego™ toys do have critical limitations.

Firstly, Lego™ bricks can only be connected in one dimension, namely upwards and downwards. This restricts the child's imaginative powers. Secondly, a Lego™ brick set, as typically provided, is designed to construct certain pre-defined structures, owing to the limits of the connection mechanism of this type of toy. Generic Lego™ bricks fail to offer unfettered flexibility for children to play. Therefore, a range of specially designed bricks are provided. Children's play thus becomes a task of rebuilding a pre-defined structure according to directions, the antithesis of imaginative play.

Thirdly, owing to the male and female connectors on the surface of Lego™ bricks, the upper and bottom surfaces of the bricks are not smooth. This technical feature of the bricks limits their free movement and restricts how they may be used. Lego™ bricks cannot—for example—slide over each other as with traditional wooden blocks.

Some other toy sets also feature a three-dimensional constructional capacity. As an example: K'Nex toys, which is described in U.S. Pat. No. 5,238,438, provides a set of rods and connectors that provide an ability for a child to construct various permutations of 3D structures. The rods and sockets architecture of this set results in constructions that are necessarily skeletal in design. As a consequence, constructions tend not to be realistic in appearance, and playing with such a set may not be satisfying from a child's perspective.

Other toys sets such as magnetically attracted square frames used to construct 3D structures have been proposed, but the connection of magnetic parts tends to be weak. It is in practice difficult to construct larger structures, and also the types of structures that can be built using these toys are limited. An example of this style of toy set is disclosed in U.S. Pat. No. 9,022,829.

Some other types of construction sets use slotted plates or cards to build 3D structures. The slots and cards can interlock with each other. However, because the building units are limited in terms of their shapes and sizes (card shaped units), the structures they can make are also very limited. An example of this type of construction is disclosed in U.S. Pat. No. 5,833,512.

A limitation shared by the various styles of prior art toy construction kits available is that they do not necessarily reflect how the physical structures are constructed or mentally imagined. Even though these various approaches provide enjoyable play, they do not offer the benefit of learning how buildings or objects are built in real life. An objective of the present invention is to at least attempt to address some of these and other limitations of existing toy construction sets.

SUMMARY

The construction sets disclosed herein address technical problems in the art by providing better modelling of how physical structures are actually constructed or conceived to encourage imaginative play, or at least provide a useful alternative to existing approaches.

The technical solutions disclosed herein involve providing a set of interconnecting blocks and connectors in which the connectors feature pins disposed on opposing sides of a base plate and/or in spaced apart arrangement. The pins are releasably engaged with cooperating apertures formed in the blocks, thus permitting various complex permutations of interconnected blocks to be constructed, to model life-like or fantastic creations as part of imaginative play.

Advantageous effects of these constructions sets include a boundless variety of interconnecting permutations of blocks by virtue of the versatility offered by the mode of interconnection as a consequence of the co-operating configurations of the blocks and the connectors.

In one aspect a toy construction set comprising operatively interconnecting blocks and connectors is provided, each of the blocks having one or more apertures formed in relief, and each of the connectors having a base and a plurality of pins attached to the base and arranged in a spaced apart manner for interconnecting blocks by positively engaging and being releasably retained within one or more of the apertures of the blocks.

Apertures and pins of the blocks and connectors can be respectively arranged in an equally spaced relationship for versatile interconnection.

The apertures and pins interconnect by positive engagement, which is releasably retained. A simple snap fit or friction fit between apertures and pins may suffice, as would be appreciated by those skilled in the art.

A variety of such fits could be adopted as required, using materials, configurations and tolerances as required. The releasable fit is such that it permits a construction to maintain integrity during play, but can be readily prised apart manually by small children.

Typically, located along the surfaces of building blocks, preferably there are equally spaced apertures in the form of small holes. These holes may be designed and located particularly so that when any two blocks are put side-by-side, their holes are spaced apart equally and continuously.

Block surfaces may also feature apertures in the form of equally spaced slots. Preferably, the slots are located particularly so that when any two blocks are put side-by-side, their holes and slots are equally spaced apart.

Connectors are made of a connector base and a number of connector pins. The connector base is preferably a rigid plate. The connector base may be of many different shapes and size in order to suit the size of the blocks to be connected. A connector plate may also be provided that has a number of pins integral with the base. The pins can be located at different locations and sides of the base to provide a variety of possible connections with blocks.

Connectors can be classified as having three different types of base: a 2D base, a 3D base, and an elastic base. A connector having a 2D base may be essentially a flat plate, having any particular shape. A connector having a 3D base may be typically formed from more than one plate, or may alternatively have a more complicated (or indeed) arbitrary structure. A connector having an elastic base may be configured so that it can bend, curve or twist, or is hinged or otherwise arranged to be reconfigurable.

Connectors may also be classified according to the configuration of their pins Together with the pins, the connectors may be classified according to the following types:

- Back-to-back connectors that connect two or more blocks back-to-back. The connector pins are located at the opposite side of the connector base. There can be 2, 3, 4, or pins at each side of the base, for small or bigger block connection.
- Side-by-side connectors that connect two or more blocks side-by-side. The pins are located at the same side of the connector base and the number of pins can be 2, 3, 4, or other numbers, for bigger or more block connections.

A child can play with the blocks without using the connectors, if they prefer. The configuration of the blocks—in which apertures are formed in recess—permits play in the same manner as with traditional wooden blocks. Even though the blocks have small hole arrays on the surface, the surface is effectively smooth, in the sense of being uninterrupted by external projections. The blocks can as a consequence slide against and over each other in the ordinary course of events.

Fundamentally, the primary principle of play is that a child can use connectors to extend and aggregate their constructions as they choose, to construct any arbitrary form.

A child can use longer or bigger connectors to group existing blocks into certain bigger structures as they like. Larger connectors can interconnect several (that is, more than two) blocks. Certain interconnections can be 'reinforced' by adding additional connectors onto different parts of interconnected blocks.

As an example, a basic set may comprise thin and long planks, strong corner rods, triangular blocks, thin and short sticks, etc. The connectors may include simple two pin or four pin connectors, as well as longer length connectors that hold up a number of planks, corner connectors, and connectors with hinges. Using these items the child can combine those parts to model a house, a bridge, a tower, etc. By adding more items, such as round blocks and connectors having a rotational joint, a child can model mechanisms such as a car, or a train.

Imaginative play is a worthwhile objective as it serves to develop an understanding of geometry and three-dimensional objects, an ability to assemble and build new structures, as well as physical skills in manipulating various building blocks and their connectors.

As previously mentioned, the blocks may be smooth on their surfaces, so that the child can move other blocks over the surface just as they might do with traditional wooden blocks. This improves the ability of the new toy to be used to construct miniature models of real structures such as houses, buildings, bridges, towers, trains and railways, etc. in similar ways as to how those structures are built in real life. This helps a child to learn how the real world works, in a fun and creative way.

The toy construction set disclosed herein also finds application in physically modelling or demonstrating complex structures such as: chemical structures, for example complex molecules or indeed sub-atomic structures; astronomical structures for example a sun and its planets and moons; architectural structures and so on.

The blocks do not require any structural connectivity features projecting from any surface of the building blocks. All surfaces of the building blocks are smooth, or uninterrupted, and can be stacked upon each other in the traditional manner.

A matrix of small holes or array of narrow slots provides a universal fixing point to install connectors. The design of the locations of the holes and slots provides ways to connect two or more blocks together through the connectors, and at the same time reserves the ability of rotation or movement in one dimension (sliding)—depending on the connector types used.

The connectors may be designed of several types, from simple two pin connectors, to complicated 3D connectors with multiple fixing points, and multiple pins at each fixing point.

The connectors are designed to attach two blocks together. As the blocks have holes or slots on their faces, any two blocks may be connected at any of its surfaces. This affords the capability of three-dimensional connections along all axes.

Connectors may be designed to have rotational joints, hinges, telescopic extensions and various related mechanisms. These functions add new features and flexibility to the overall structure, without changing the shape of the structures.

The interchangeable terms 'blocks' and 'bricks' are used herein, often in a context that implies a generally cuboid-shaped configuration. While this is typically the case, this term is in fact used without any particular limitations as to shape either general or particular, unless manifest from its context of usage

BRIEF DESCRIPTION OF THE DRAWINGS

The invention will be better understand in relation to the following mode(s) for carrying out the invention, which makes reference to the following drawings, wherein:

FIG. 2 collectively depicts in perspective view various example blocks according to an embodiment of the present invention, wherein:

FIG. 3 collectively depicts in perspective view various example connectors according to an embodiment of the present invention, wherein:

FIG. 4 collectively depicts in perspective view various examples of interconnected blocks according to an embodiment of the present invention, wherein:

DETAILED DESCRIPTION OF THE PREFERRED EMBODIMENTS

The best mode for carrying out the invention is directed towards a specific embodiment of a toy construction set for a child to play with and create different types of structures.

Figure 1:
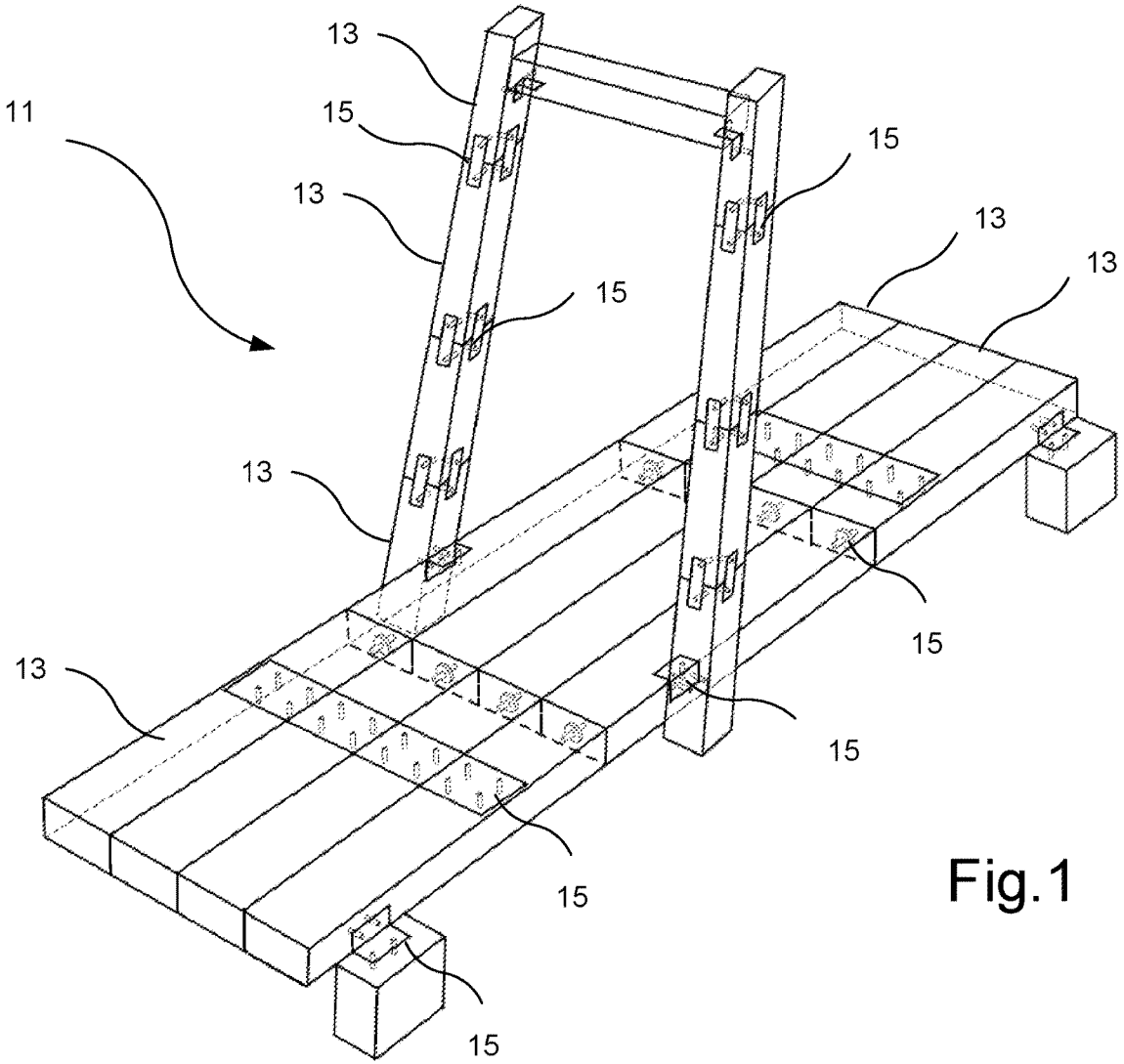
FIG. 1 depicts in perspective view an example of a structure constructed using a combination of blocks and connectors provided according to an embodiment of the present invention.

As shown in FIG. 1, an example of a structure 11 constructed using a set according to an embodiment of the present invention is depicted, which comprises a combination of two types of components: namely, building blocks 13, and connectors 15.

This structure 11 is representative of a cable-stayed bridge—or at least a portion of such a bridge. This construction may be inspired by or evocative of the San Francisco Golden Gate Bridge, for example, and provide imaginative play opportunities of the kind generally associated with toy construction sets. The type and range of structures that are possible are effectively limitless, as is apparent from the specific description which follows regarding the example blocks and connectors described and depicted.

Different types of blocks 13 that form part of the toy construction set are as follows.

Figure 2C:
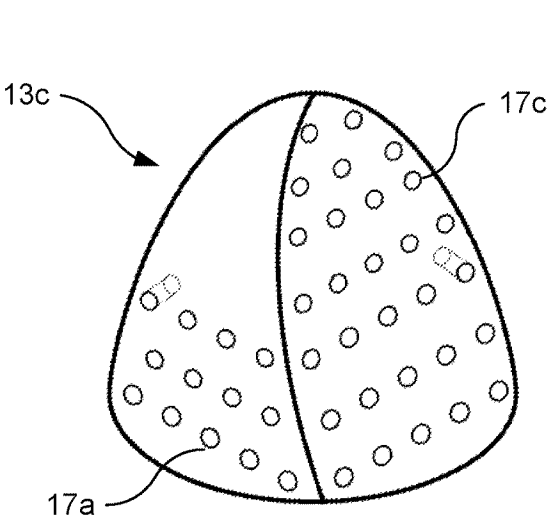
FIG. 2C is an oblique view of a hemispherical segment block.
Figure 2B:
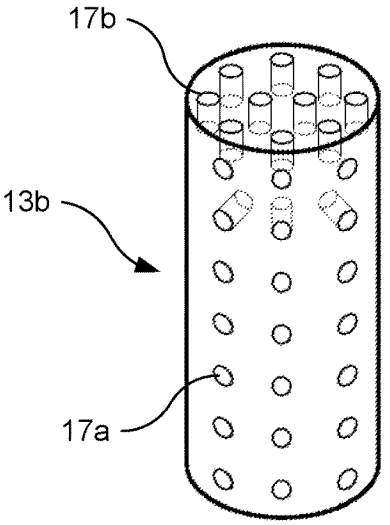
FIG. 2B is an oblique view of a cylinder block.
Figure 2A:
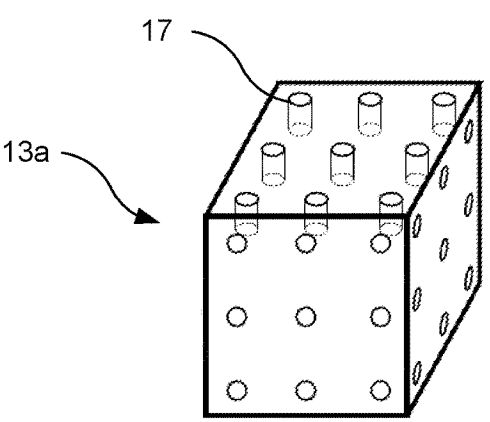
FIG. 2A is an oblique view of a cube block.

A cube block 13*a* having a simple cubic shape is depicted in FIG. 2A that has longitudinal apertures orthogonal to the surface in the form of simple holes 17 formed in recess in a regular 3×3 array on each of the 6 faces of the block.

A cylinder block 13*b* having the shape of a circular cylinder is depicted in FIG. 2B. Again apertures in the form of simple holes 17 are formed in recess radially 17*a* along the length of the cylinder in angular spaced lines or axially 17*b* on each of the opposing end of faces of the cylinder in angularly spaced diametral lines.

A hemispherical segment block 13*c* having the shape of a hemispherical segment is depicted in FIG. 2C, that has apertures in the form of simple holes 17 formed in recess in its plane surfaces, radially 17*a* on the curved face and orthogonally 17*c* on the sector face.

Figure 2E:
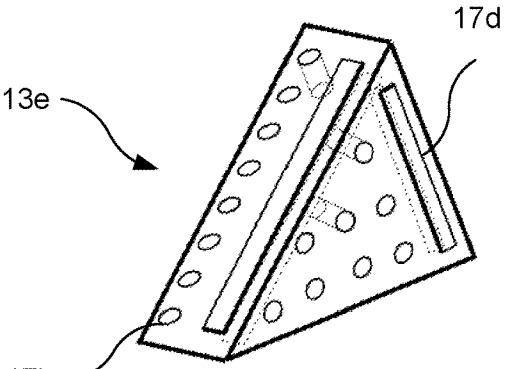
FIG. 2E is an oblique view of a triangular prism plate block.
Figure 2D:
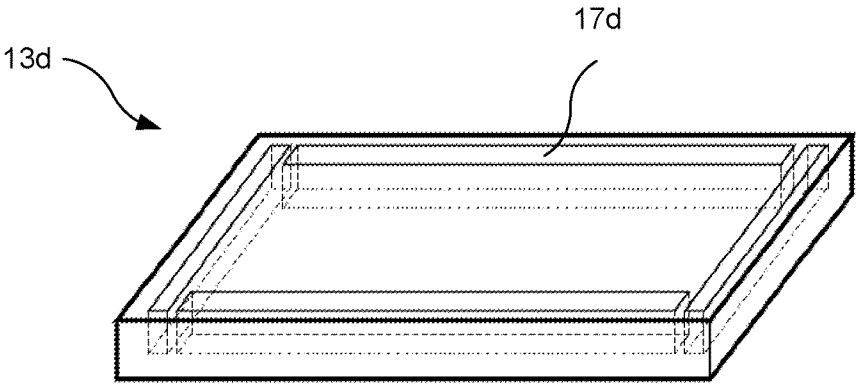
FIG. 2D is an oblique view of a cuboid plate block.

A cuboid plate block 13*d* having a cuboid shape, of elongated, plate-like configuration is depicted in FIG. 2D, that has apertures in the form of slots 17*d* separately formed near peripheral edges of opposing major faces of the block.

A triangular prism plate block 13*e* having a shape of a planar triangular shape is depicted in FIG. 2E, that has apertures in the form of both holes 17*b* and slots 17*d* formed in recess as shown along major and minor faces of the block.

Figure 2F:
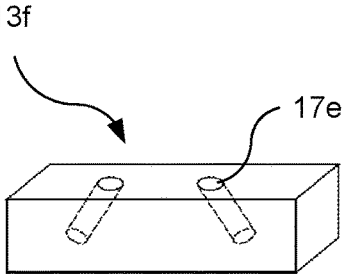
FIG. 2F is an oblique view of a cuboid block having a pair of spaced oblique apertures.
Figure 2G:
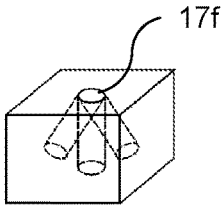
FIG. 2G is an oblique view of a cube block having three card located apertures in a tripod configuration.

A cuboid block 13*f* is depicted in FIG. 2F (sheet 5) comprising two spaced apart apertures in the form of oblique holes 17*e* which are adapted for receiving pins (not shown) that are oblique to their base plates. Similarly, a cube block 13*g* is depicted in FIG. 2G comprising three collocated apertures in the form of holes 17*f* arranged in a tripod configuration, which are adapted for receiving pins that are oblique to their base plate.

Various configurations of connectors could be used to inter-engage with such blocks, as will become apparent.

Different types of connectors that form part of the toy construction set are as follows.

Figure 3M:
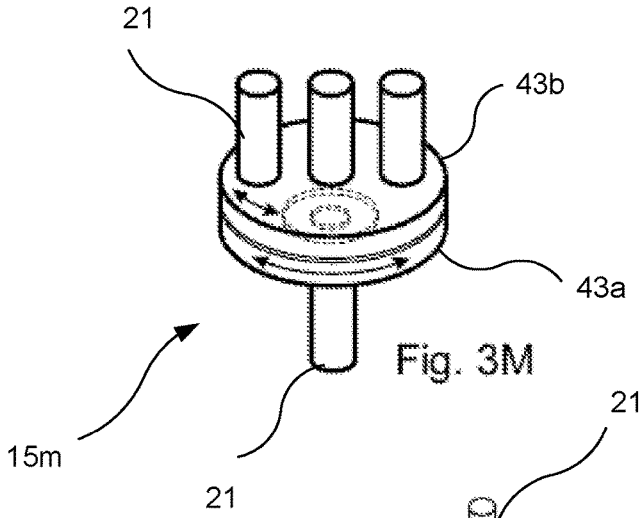
FIG. 3M is an oblique view of a circular socket joint connector having a single pin on one side plate and three linear pins on another side plate, the plates being juxtaposed and rotatable relative to each other.
Figure 3N:
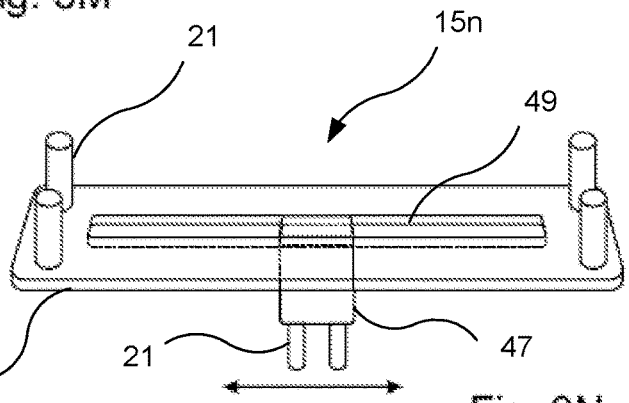
FIG. 3N is a perspective view of a rectangular slider plate connector having four pins on one side and two pins on the other.
Figure 3O:
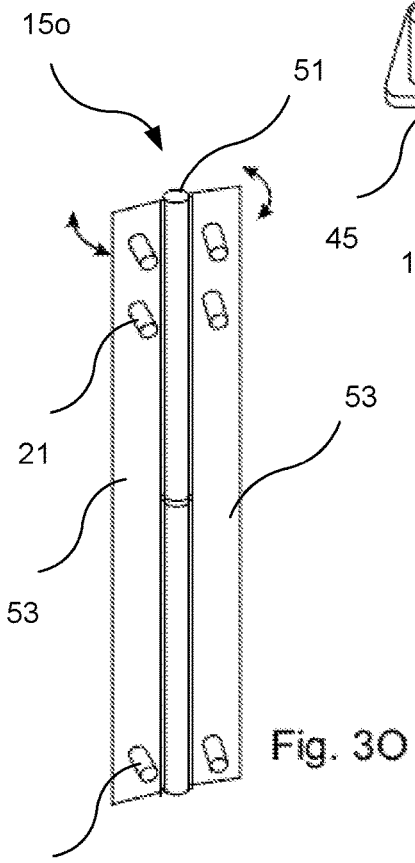
FIG. 3O is a perspective view of a hinge plate connector.
Figure 3P:
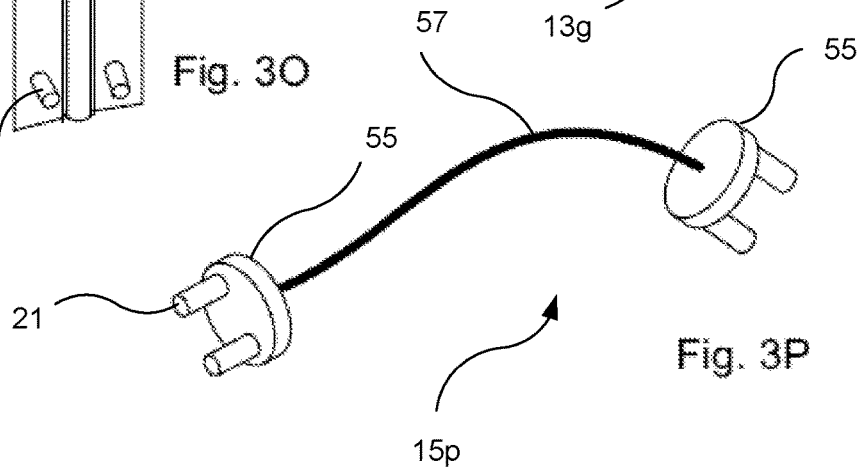
FIG. 3P is a perspective view of a flexible circular base plate connector having two flexibly interconnected circular plates, each plate having to outer pins.
Figures 3A, 3B, 3C, 3D, 3E, 3F, 3G:
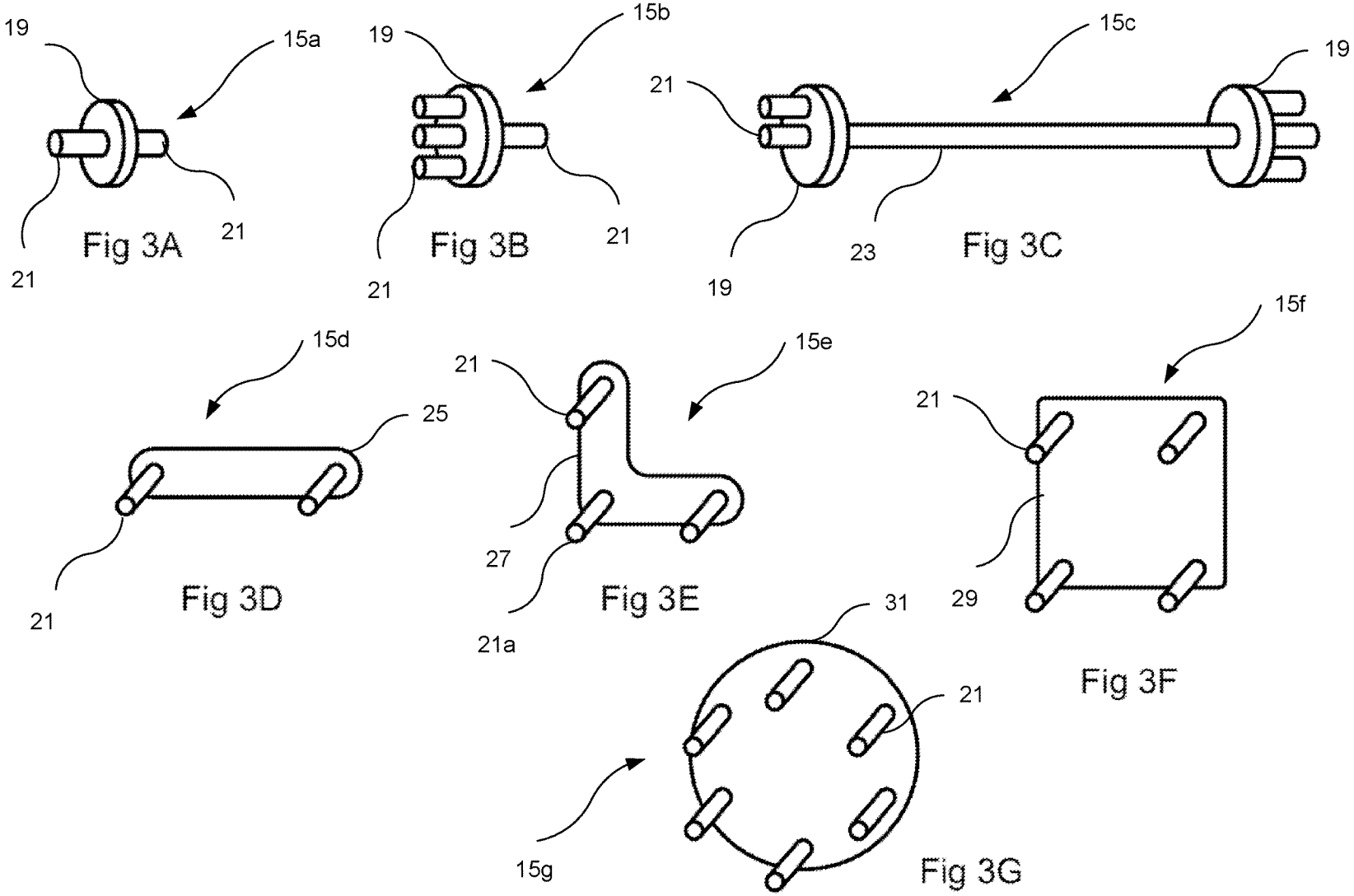
FIG. 3A is an oblique view of a circular base plate connector having a single pin on opposing sides.
FIG. 3B is an oblique view of a circular base plate connector having three linear pins on one side and one pin on the other.
FIG. 3C is an oblique view of a double base plate rod connector having two linear pins on the outer side of one plate and three equiangular pins on the other side of the other plate.
FIG. 3D is an oblique view of an elongated plate connector having a pair of distally opposed pins on the one side of the plate.
FIG. 3E is an oblique view of an elongated right angle plate connector having a pair of distally opposed pins and an intermediate junction pin on the one side of the plate.
FIG. 3F is an oblique view of a square plate connector having four pins, one disposed at each of the corners on the one side of the plate.
FIG. 3G is an oblique view of a circular plate connector having six equiangular pins on the one side of the plate.

A circular base plate connector 15*a* having a circular base plate 19 and two pins 21 respectively projecting from opposed sides of the base plate 19 is depicted in FIG. 3A.

A circular base plate connector 15*b* is depicted in FIG. 3B having a similar configuration as that shown in FIG. 3A, though with three pins 21 projecting from one side of the base.

A double base plate rod connector 15*c* is depicted in FIG. 3C that has a similar configuration to that shown in FIG. 3B, though the connector comprises two spaced apart base plates 19 adjoined by an intervening rod 23. Each of the spaced apart opposing sides comprise a circular base plate 19 and feature a different number of pins 21.

An elongated plate connector 15*d* is depicted in FIG. 3D having spaced apart pins 21 projecting from matching sides and opposite ends of an elongate base plate 25.

An elongated right angle plate connector 15*e* is depicted in FIG. 3E similar to that shown in FIG. 3D, though having an L-shaped base plate 27 rather than a simple elongate base plate. The elongated right angle connector 15*e* has a pair of distally opposed pins 21 and an intermediate junction pin 21*a* on the one side of the plate A square plate connector 15*f* is depicted in FIG. 3F, which is also similar to that shown in FIG. 3D, though having a base plate 29 of square shape, and a 2×2 array of pins 21 all projecting from one face of the base plate.

A circular plate connector 15*g* is depicted in FIG. 3G, which is similar to that shown in FIG. 3F, though having a base plate 31 of circular shape, and a series of 6 equiangular pins 21 spaced apart at regular intervals around a periphery of the base plate on one side.

Figure 3J:
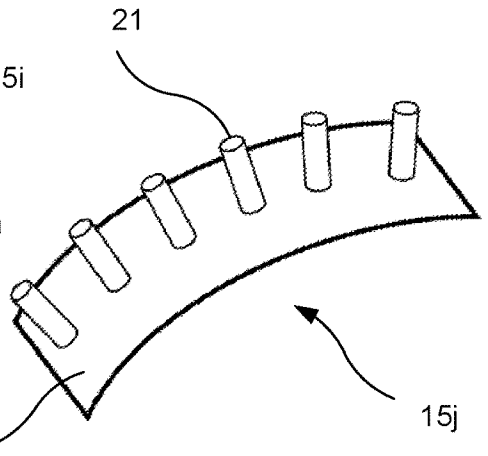
FIG. 3J is an oblique view of a curved base connector having six linear pins disposed on the outer convex side of the base.
Figure 3I:
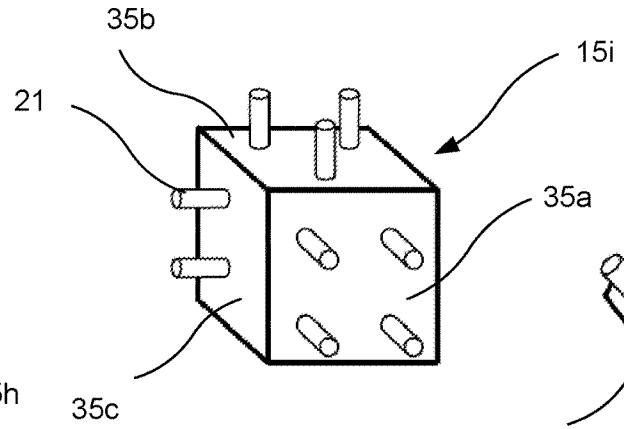
FIG. 3I is an oblique view of an internal corner connector having three interconnected square plates, one having two linear pins, another having three equiangular pins, and another having four pins at each of the corners, all on the outer side of the plate.
Figure 3H:
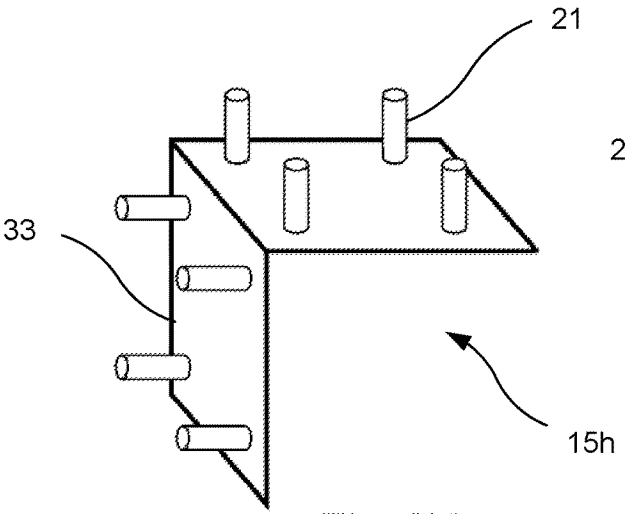
FIG. 3H is a square bracket connector having four pins, one disposed at each of the corners of the base plates, all on the outer side of the plate connector.

A square bracket connector 15*h* is depicted in FIG. 3H similar in some respects to the square-shaped connector 15*f* shown in FIG. 3F, though arranged in a right angle L-shaped configuration with pins 21 projecting from orthogonal base plates 33 to form a square bracket.

An internal corner connector 15*i* is depicted in FIG. 3I that is arranged as an internal corner, and accordingly features three orthogonally arranged base plates 35. As depicted, each base plate 35 has a different arrangement of pins 21. Respective base plates 35*a*, 35*b* and 35*c* are depicted having pins 21 arranged in a 2×2 array, a trio of pins 21 in a triangular pattern, and a pair of pins 21 in a spaced apart arrangement.

A curved base connector 15*j* is depicted in FIG. 3J having a curved base 37, of constant radius of curvature. Related variations may have base plates that are flexible, and deformable or resilient. In the present example, the six linear pins 21 are disposed on the outer convex side of the base 37.

Figure 3L:
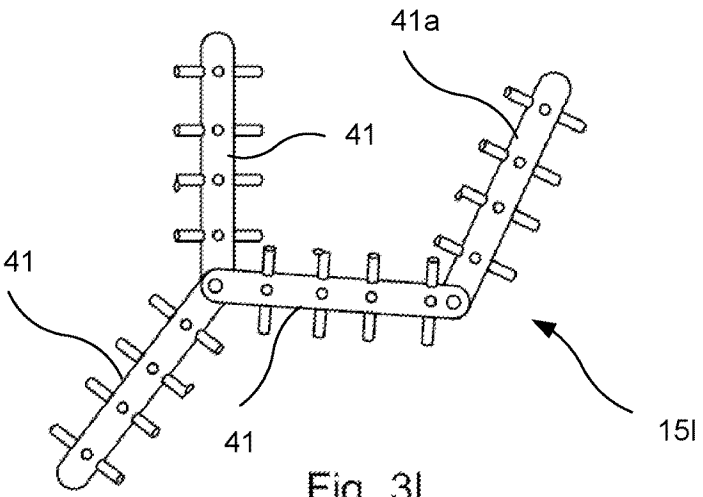
FIG. 3L is a plane of view of an articulated connector made up of a set of rod connectors.
Figure 3K:
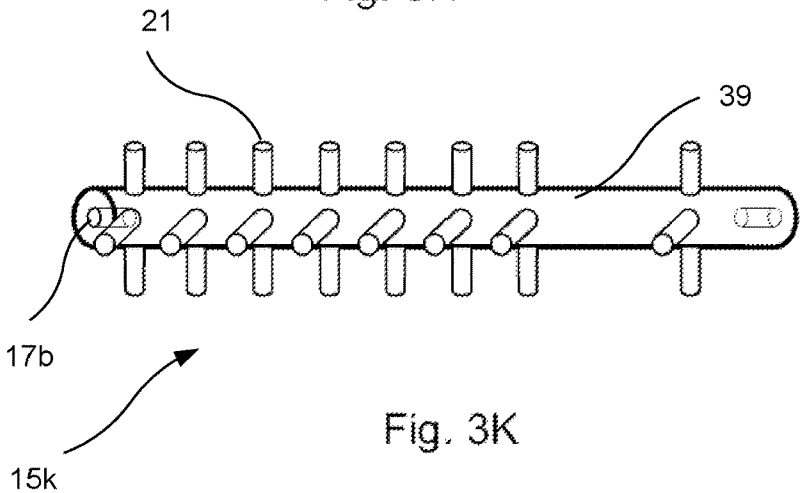
FIG. 3K is an oblique view of a circular rod connector having four linear sets of pins equiaxially disposed radially of the rod and opposing axial apertures disposed at opposite ends of the rod.

A circular rod connector 15*k* is depicted in FIG. 3K having a base formed as a rod 39, specifically a circular cylinder, with four linear sets of pins 21 arranged projecting from the rod along its length. The linear sets of pins are equally axially disposed radially along the rod 39 3 and opposing axial holes 17*b* are disposed at opposite ends of the rod An articulated connector 15*l* is depicted in FIG. 3L similar to the rod connector 15*k* of FIG. 3K, though configured as a complex of articulated rod connectors 41. This particular connector as depicted comprises a three-pointed star, one point of which has an additional articulated leg 41*a*.

A circular socket joint connector 15*m* is depicted in FIG. 3M that has a rotating socket joint, arranged to rotate a single pin 21 on one side plate 43*a* with a series of three linearly aligned spaced apart pins 21 on another side plate 43, the side plates being juxtaposed and rotatable relative to each other.

A rectangular slider plate connector 15*n* is depicted in FIG. 3N that has a base 45 featuring reciprocating articulation of a slider 47, and arranged as a simple longitudinal member having pairs of pins 21 spaced apart at terminal ends of the base 45, facing in one direction, and opposed by a pair of pins 21 on the slider 47 facing in an opposing direction, the slider being slidable within a slot 49 between these terminal ends.

A hinge joint connector 15*o* is depicted in FIG. 3O having a simple longitudinal orientation, though hinged at a mid-point to permit pivoting articulation. This type of connector comprises a hinge 51 linking to base plates 53. On each of the base plates 53 there are arrays of pins 21 that can be used to connect blocks 13. After both of the base plates 53 are connected to blocks 13, the two groups of blocks are linked by the hinge 51 in the centre. In this way, the final structure can have moving parts provided by way of the hinge joint connector 150.

A flexible circular base plate connector 15*p* is depicted in FIG. 3P comprising two bases 55, each having a pair of pins 21 on one side only, and connected on the opposing faces by a flexible cord 57, which may also be deformable or resilient or elastic.

The spacing and size of the apertures 17 in the blocks 13 and the pins 21 of the connectors are determined by the following factors:

(i) How easily a child can put the connectors 15 into the apertures 17 of the blocks 13.

(ii) How good the connection strength is between a connector 15 and a block 13 to which it is connected.

(iii) The relative size of the blocks 13 and the connectors 15.

A minimum spacing between adjacent apertures 17 and adjacent pins 21 is determined taking into account the aforementioned factors. In all cases, the size of each of the apertures 17 and pins 21, will remain the same. However, the spacing of the apertures 17 and/or slots 17*d* of a given set of toys will be an integer multiple of the minimum spacing between adjacent apertures and/or slots (i.e. 1×minimum spacing, 2×minimum spacing (double), 3×minimum spacing (triple), etc). This will ensure compatibility of all types of connectors 15 on various types of blocks 13 from different sets of toys, whilst simultaneously meeting the different requirement of when blocks are of different sizes.

Also, the distribution of the apertures 17 on the surface of the blocks is not necessarily evenly or equally distributed. At some locations of the blocks 13, where the connections are intended to be more concentrated, there can be more apertures 17 than at some other parts of the blocks where the connections are intended to be less concentrated. However, with some generic types of blocks 13, the apertures 17 can be equally spaced or equidistant to each other.

A selection of simple interconnected constructions 57 are depicted by way of non-limiting examples in FIG. 4. Typically such constructions 57 would be used as a basis for further construction, as exemplified by the cable-stayed bridge 11 of FIG. 1.

Figure 4A:
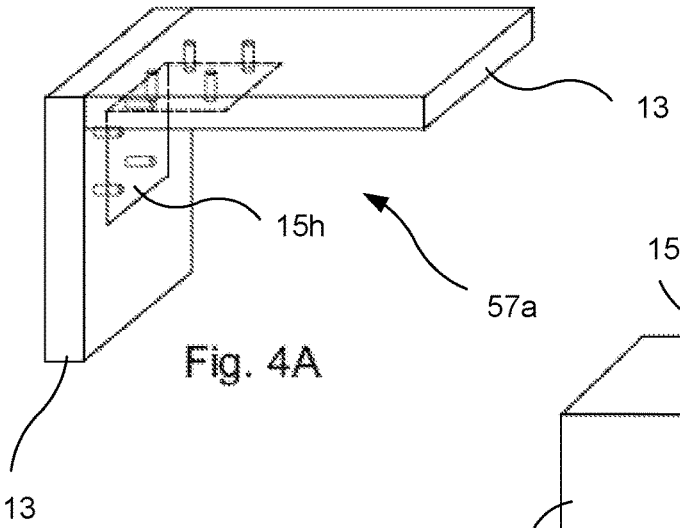
FIG. 4A is an oblique view of a right plate joint construction.

FIG. 4A depicts a right plate joint construction 57*a* comprising two blocks 13 having planar shape similar to 13*d*, interconnected by a square bracket connector 15*h* similar to that of FIG. 3H.

Figure 4B:
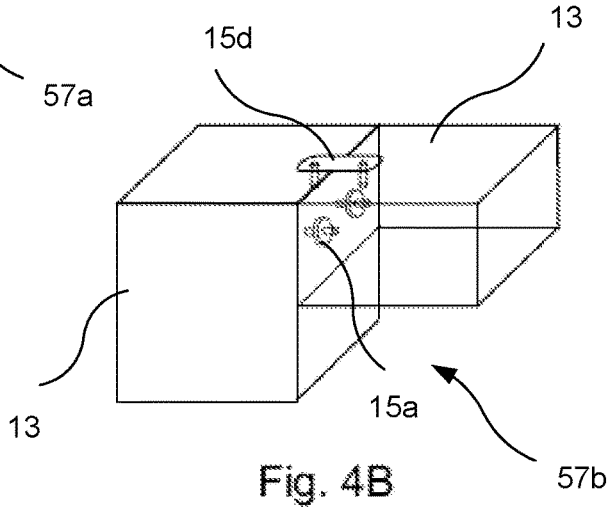
FIG. 4B is an oblique view of a right block joint construction.

FIG. 4B depicts a right block joint construction 57*b* comprising two blocks 13, of different cuboid shapes, joined by two different styles of connector 15*a* and 15*d*, respectively depicted in FIGS. 3A and 3D. Two simple circular base plate connectors 15*a* (FIG. 3A) interconnect the blocks at their abutting faces, while a simple elongated plate connector 15*d* (FIG. 3D) provides an additional 'reinforcing' interconnecting adjacent faces of the blocks as depicted.

Figure 4C:
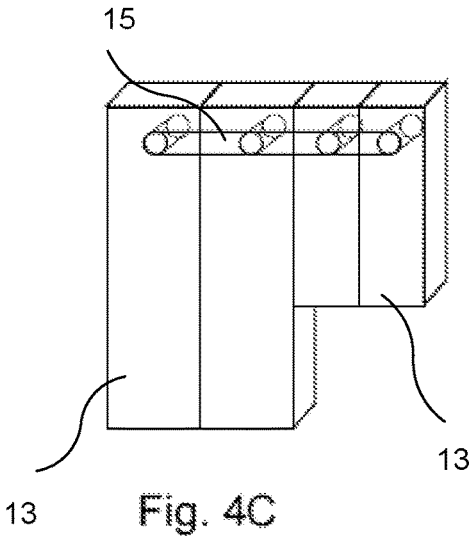
FIG. 4C is an oblique view of a planar joint construction.

FIG. 4C depicts a planar joint construction 57*c* comprising a series of planar blocks 13 interconnected by a single plate connector 15 which spans each of the blocks. The connector has four pins, each of which releasably retains a respective block 13 of the series of four blocks.

Figure 4D:
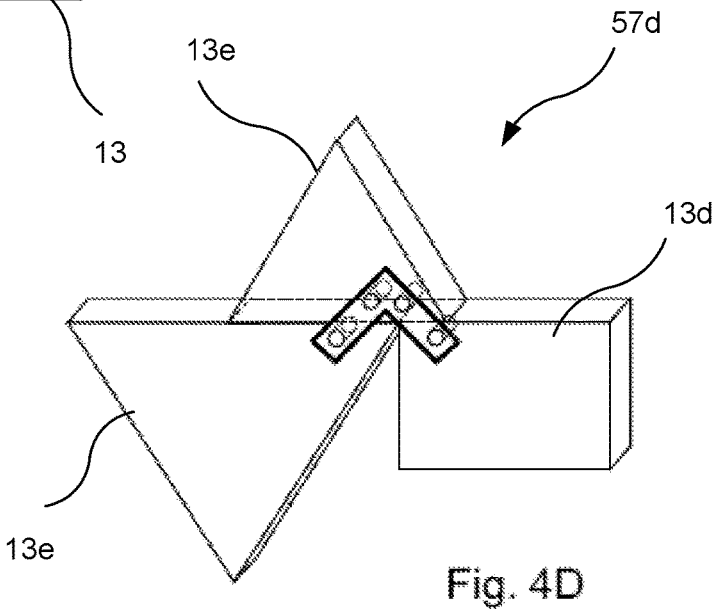
FIG. 4D is an oblique view of a construction comprising an interconnected set of triangular prism plate blocks and a cuboid plate block.

FIG. 4D depicts a construction 57*d* of three blocks comprising two triangular prism plate blocks 13*e* and a cuboid plate block 13*d*, interconnected with an elongated right angle plate connector 15*e* similar to that of FIG. 3E.

Figure 4E:
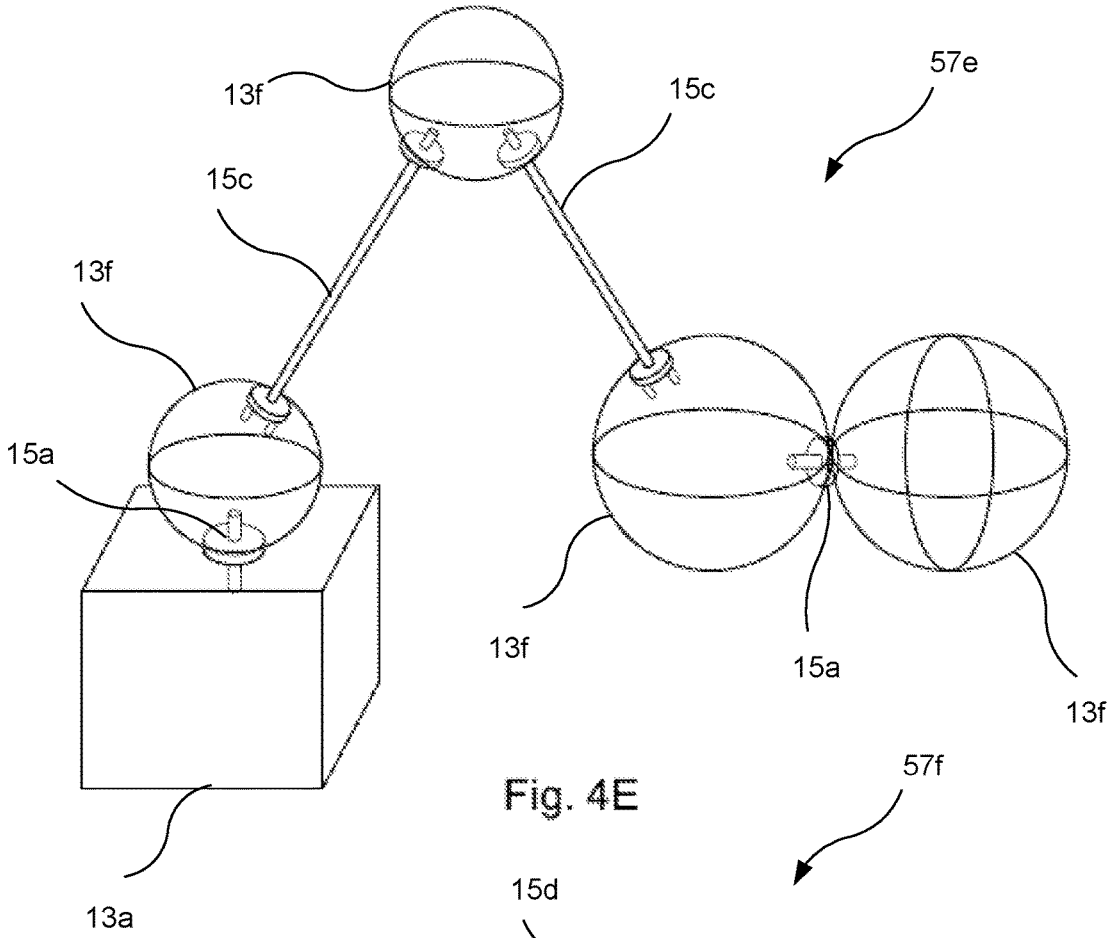
FIG. 4E is an oblique view of a construction comprising an interconnected set of spherical blocks and a cube block.

FIG. 4E depicts a construction 57*e* of blocks comprising circular blocks 13*f* and a cube block interconnected by simple circular base plate connectors 15*a* (FIG. 3A) and double base plate rod connectors 15*c* (FIG. 3C). A similar style of construction can be used to model atomic structures.

Figure 4F:
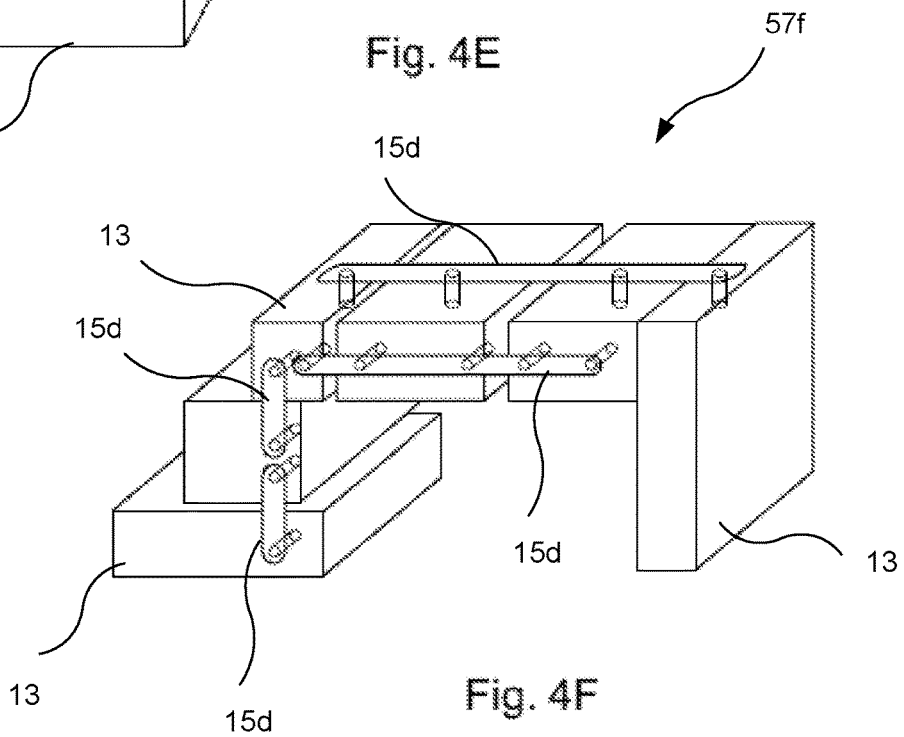
FIG. 4F is an oblique view of a set of cuboidal blocks interconnected to form a complex construction.

FIG. 4F depicts a construction 57*f* comprising a complex of interconnected cuboid blocks 13 using elongated plate connectors 15*d* (FIG. 3D) and side-by-side connectors (FIG. 3D). A similar style of construction can be used to model architectural structures.

Returning to FIG. 1, which models a cable-stayed bridge, it is apparent that such a structure can be modelled using a construction 11, as depicted, comprising a judicious selection of blocks 13 and connectors 15. Cuboid blocks (FIG. 2A) model bridge supports or piers, planar blocks 13*d* (FIG. 2D) model a bridge deck, while elongated cuboid blocks (FIG. 2A) model a tower.

The piers and deck (and the towers and deck) are interconnected by square bracket connectors 15*h* (FIG. 3H). The deck is interconnected by circular base plate connectors 15*a* (FIG. 3A) and reinforced by square plate connectors 15*f* (FIG. 3F). Each of the towers are interconnected by elongated plate connectors 15*d* (FIG. 3D). The towers are spanned by an elongated cuboid block (FIG. 2A) modelling a buttress. The buttress is interconnected to the towers by square bracket connectors 15*h* (FIG. 3H).

As will be appreciated, a boundless variety of other models can be constructed. Additional examples are provided in FIGS. 4G and 4H.

Figure 4G:
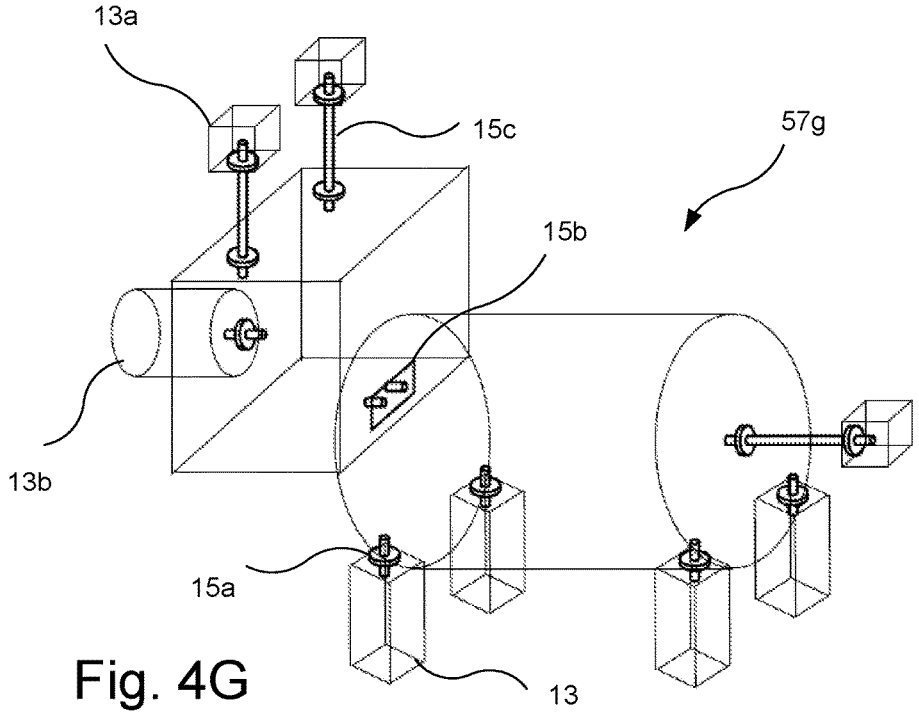
FIG. 4G is an oblique view of a complex construction formed of blocks and connectors to model a dog.
Figure 4H:
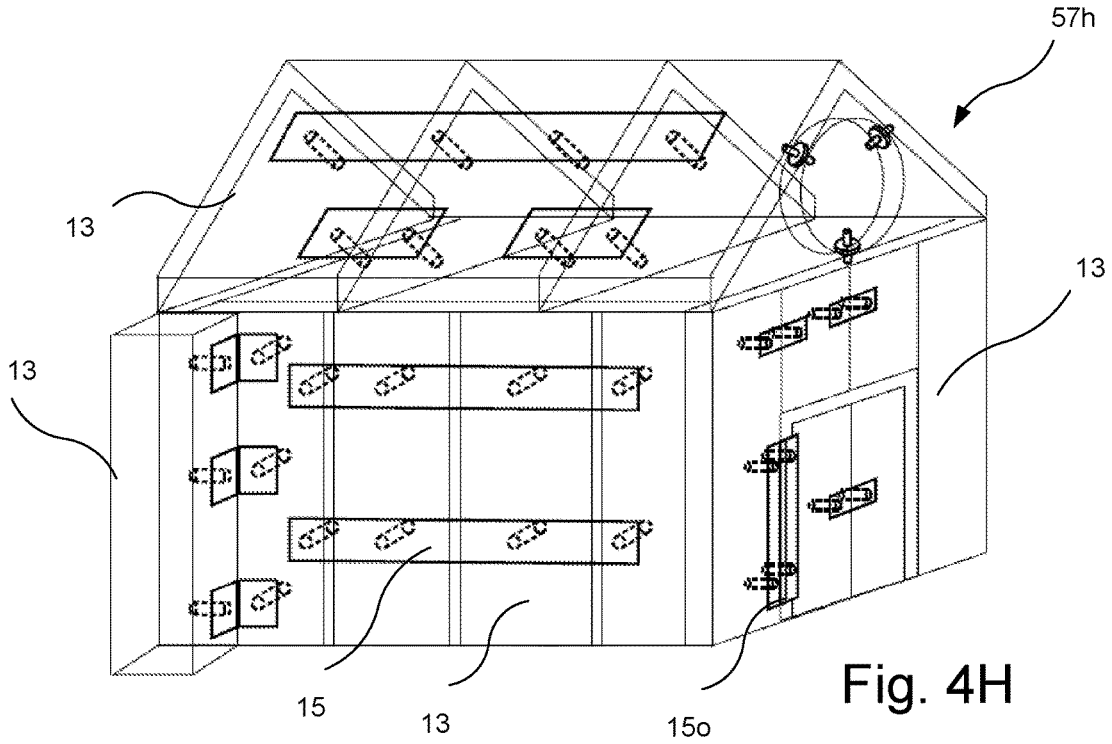
FIG. 4H is an oblique view of a complex construction formed of blocks and connectors to model a house.

As is apparent, FIG. 4G depicts a construction 57*g* comprising a complex of blocks 13 (cube, cylinder, cuboid) interconnected by connectors 15 (double base plate rod, circular base plate, elongated plate) which model a dog, while FIG. 4H depicts a construction 57*h* comprising a complex of blocks 13 (cuboid, cuboid plate) interconnected by connectors 15 (elongated plate, square bracket, circular bracket, hinge) which model a simple house.

Blocks and connectors can be formed in various structures, without any particular limitations. For example, in the construction 57*g*, instead of using orthogonal apertured blocks and orthogonal pin connectors, oblique apertured blocks such as 13*f* and 13*g*, and/or oblique pin connectors (not shown) can be used to provide more authenticity to the angular arrangement of these components in achieving the model of the dog.

Further still, the blocks can slide against and over each other owing to the apertures being formed in recess, and the absence of projecting members—thereby allowing the blocks to be manipulated in the same manner as traditional wooden blocks, without the use of connectors.

Similar utility can be achieved with the connectors themselves, whereby some of the connectors can be interconnected to each other directly, and in this manner can be manipulated without the use of blocks.

The invention claimed is:

1. A toy construction set comprising:

operatively interconnectable blocks and first connectors;

each of the blocks having a plurality of sides, each side being defined by edges of the block and providing a smooth sliding surface of the block, and a plurality of apertures formed in relief in each of the sides, wherein the apertures in any side are spaced from the respective edges of the block; and each of the first connectors having a flexible base in the form of a thin plate and a plurality of pins having a cross-section that is circular and projecting integrally from one side of the base in a spaced apart arrangement for interconnecting blocks by positively engaging and being releasably retained within respective apertures of the blocks;

whereby any two of the blocks can be interconnected at any of their sides by one or more of the first connectors.

2. A toy construction set as claimed in claim 1, wherein the apertures comprise holes or slots or a combination of holes and slots.

3. A toy construction set according to claim 2, wherein the holes have a circular cross-section.

4. A toy construction set as claimed in claim 1, wherein one or more of the first connectors additionally comprises at least one pin of circular cross-section projecting integrally from an opposite side of the base.

5. A toy construction set as claimed in claim 4, wherein the base comprises a first base plate comprising one side of the base, a second base plate comprising the opposite side of the base and a rod or flexible connection joining the first and second base plates.

6. A toy construction set according to claim 4, wherein the base comprises a first portion including the one side of the base and a second portion including the opposite side of the base and one of the first and second portions is articulated by a reciprocating slidable arrangement relative to the other of the first and second portions.

7. A toy construction set according to claim 4, wherein the base comprises a first base plate comprising one side of the base and a second base plate comprising the opposite side of the base, the first and second base plates being juxtaposed and rotatable relative to each other.

8. A toy construction set as claimed in claim 1, wherein the set additionally comprise one or more second connectors having a base and at least two pins of circular cross-section projecting integrally from opposed sides of the base.

9. A toy construction set as claimed in claim 8, wherein the base comprises a first base plate comprising one side of the base, a second base plate comprising the opposite side of the base and a rod or flexible connection joining the first and second base plates.

10. A toy construction set according to claim 8, wherein the base comprises a first portion including the one side of the base and a second portion including the opposite side of the base and one of the first and second portions is articulated by a reciprocating slidable arrangement relative to the other of the first and second portions.

11. A toy construction set according to claim 8, wherein the base comprises a first base plate comprising one side of the base and a second base plate comprising the opposite side of the base, the first and second base plates being juxtaposed and rotatable relative to each other.

12. A toy construction set as claimed in claim 1, wherein the set additionally comprises one or more third connectors having a base and pins of circular cross-section that project integrally therefrom in two or three orthogonally oriented directions.

13. A toy construction set as claimed in claim 1, wherein the pins project from the base at oblique angles.

14. A toy construction set as claimed in claim 1, wherein the pins project from the base in a common axially aligned direction.

15. A toy construction set as claimed in claim 1, wherein the base is articulated by a hinge.

16. A toy construction set according to claim 1, wherein the base is curved.

17. A toy construction set according to claim 1, wherein the base comprises a rod.

* * * * *